US006323826B1

(12) United States Patent
Sievenpiper et al.

(10) Patent No.: US 6,323,826 B1
(45) Date of Patent: Nov. 27, 2001

(54) TUNABLE-IMPEDANCE SPIRAL

(75) Inventors: Daniel Sievenpiper, Los Angeles; Robin J. Harvey, Newbury Park, both of CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/537,583

(22) Filed: Mar. 28, 2000

(51) Int. Cl.[7] ..... H01Q 3/40
(52) U.S. Cl. ..... 343/909; 343/754
(58) Field of Search ..... 343/700 MS, 909, 343/895, 754, 756

(56) References Cited

U.S. PATENT DOCUMENTS

| | | | | |
|---|---|---|---|---|
| 4,905,014 | | 2/1990 | Gonzalez et al. | 343/909 |
| 5,146,235 | * | 9/1992 | Frese | 343/895 |
| 5,519,408 | | 5/1996 | Schnetzer | 343/853 |
| 5,534,877 | * | 7/1996 | Sorbello et al. | 343/700 MS |
| 5,541,614 | | 7/1996 | Lam et al. | 343/792.5 |
| 5,923,303 | | 7/1999 | Schwengler et al. | 343/767 |

FOREIGN PATENT DOCUMENTS

WO 99/50929 10/1999 (WO) .

OTHER PUBLICATIONS

Balanis, C., "Aperture Antennas", *Antenna Theory, Analysis and Design,* 2nd Edition, (New York, John Wiley & Sons, 1997), Chap. 12, pp. 575–597.

Balanis, C., "Microstrip Antennas", *Antenna Theory, Analysis and Design,* 2nd Edition, (New York, John Wiley & Sons, 1997), Chap. 14, pp. 722–736.

Cognard, J., "Alignment of Nematic Liquid Crystals and Their Mixtures" *Mol. Cryst. Liq, Cryst.* Suppl. 1, 1 (1982) pp. 1–74.

Doane, J.W., et al., "Field Controlled Light Scattering from Nematic Microdroplets", *Appl. Phys. Lett.,* vol. 48 (Jan. 1986) pp. 269–271.

Jensen, M.A., et al., "EM Interaction of Handset Antennas and a Human in Personal Communications", *Proceedings of the IEEE,* vol. 83, No. 1 (Jan. 1995) pp. 7–17.

Jensen, M.A., et al., "Performance Analysis of Antennas for Hand–held Transceivers using FDTD", *IEEE Transactions on Antennas and Propagation,* vol. 42, No. 8 (Aug. 1994) pp. 1103–1113.

Ramo, S., et al., *Fields and Waves in Communication Electronics,* 3rd Edition (New York, John Wiley & Sons, 1994) Section 9.8–9.11, pp. 476–487.

Sievenpiper, D., et al., "High–Impedance Electromagnetic Surfaces with a Forbidden Frequency Band", *IEEE Transactions on Microwave Theory and Techniques,* vol. 47, No. 11, (Nov. 1999) pp. 2059–2074.

Sievenpiper, D., "High–Impedance Electromagnetic Surfaces", Ph.D. Dissertation, Dept. of Electrical Engineering, University of California, Los Angeles, CA, 1999.

Wu, S.T., et al., "High Birefringence and Wide Nematic Range Bis–tolane Liquid Crystals", *Appl. Phys. Lett.* vol. 74, No. 5, (Jan. 1999) pp. 344–346.

* cited by examiner

*Primary Examiner*—Don Wong
*Assistant Examiner*—Jamos Clinger
(74) *Attorney, Agent, or Firm*—Ladas & Parry

(57) ABSTRACT

A method and apparatus for providing a high impedance structure or surface comprising at least one electrically conductive wire forming at least one elongate wire spiral, the at least one elongate wire spiral being defined by a plurality of spirals of said at least one wire, the spirals having a pitch and being spaced apart along a major axis of said elongate wire spiral; and an arrangement for varying the pitch of the spirals of said at least one wire to thereby tune the impedance of said tuneable impedance structure. An embodiment useful as an antenna aperture to steer a radio frequency beam having two different polarizations is disclosed.

37 Claims, 8 Drawing Sheets

TUNABLE-IMPEDANCE SPIRAL

FIELD OF THE INVENTION

This invention relates to the field of tunable electromagnetic devices and, in particular, to tunable polarizers and beam steering devices, such being particularly useful in modern antenna and communications systems.

BACKGROUND

In modern antenna and communication systems, particularly those involving microwave and millimeter waves, the steering of electromagnetic signals plays an important role in the transmission to, or interconnection of, various system elements, such as in satellite tracking systems. The properties and characteristics of physical surfaces associated with such signals, in turn, can affect the desired transmission or reflection of the signals.

For example, it has been known for decades that the electromagnetic properties of a metal surface can be changed by applying periodic corrugations to that surface, such as corrugated surfaces used in horn antennas to improve the radiation pattern. The corrugations are typically one-quarter wavelength thick, and serve as a resonant structure to transform a low-impedance metal surface into a high-impedance surface. This affects the reflection phase of the surface, and also the propagation of surface waves along it.

The same technique can also be applied to cylindrical structures such as wires. An example is shown in FIG. 1, which is adapted from FIG. 9.9*a* in Ramo et al.'s "Fields and Waves in Communication Electronics", published by John Wiley & Sons, Third Edition, 1994. The structure succeeds in suppressing the propagation of AC currents along the wire at the resonance frequency. However, the entire structure is greater than one-half wavelength thick, which can be problematic in size/weight constrained areas, such as for use in orbiting satellites.

Therefore, there exists a need for an effective device which can improve performance of wide range of microwave and millimeter wave antennas and structures useful in satellite tracking systems, while being small in size and manufacturable at relatively low cost. The present invention provides a unique solution to meet such need.

SUMMARY OF THE INVENTION

A spiral resonant structure is used to make a wire with tunable reflection properties. The structure can be tuned by stretching the spiral, allowing one to vary the reflection properties as a function of frequency. The diameter of the spiral is small compared to the operating wavelength, and the structure can be easily fabricated as a spring. Near resonance, it is electrically isolated in that it provides as a highly reactive current path, instead of a low-impedance short. Such a structure can be applied to dispersive polarizing beam splitters, and a new class of wire grid reflectors for focusing radiative power, and, as such, can be a useful performance enhancement for antennas and other types of electromagnetic devices.

Accordingly, in accordance with the present invention, there is provided a resonant spiral wire structure, that:

(1) can be used in such a way that it appears transparent to electromagnetic radiation within a particular frequency band, while reflecting out-of-band radiation, or (2) can be used to impart a frequency-dependent phase to the reflected wave that differs from that of an ordinary straight wire, and (3) is tunable by merely stretching or compressing the spiral.

Utilizing the teachings of the present invention, a microwave polarizer can be formed wherein a layer of thin parallel wires is spaced less than a wavelength apart. The electric field component polarized along the wire is reflected, while the orthogonal component passes unreflected. With the resonant spiral, the polarization effect is frequency dependent, making the polarizer band selective. The resonant spiral approach also enables phase control of the reflected wave.

In accordance with one aspect of the present invention, a tuneable impedance structure is provided which includes at least one electrically conductive wire forming at least one elongate wire spiral, the at least one elongate wire spiral being defined by a plurality of spirals of said at least one wire, the spirals having a pitch and being spaced apart along a major axis of said elongate wire spiral; and an arrangement for varying the pitch of the spirals of said at least one wire to thereby tune the impedance of said tuneable impedance structure.

In another aspect the present invention provides a method of tuning a high impedance surface comprising: arranging a plurality of elongated wire spirals in a generally planar and parallel relationship, each spiral having a pitch associated therewith; and varying the pitch of each of the wire spirals to thereby tune the impedance of said high impedance surface.

In yet another aspect the present invention provides an antenna aperture for steering a radio frequency beam having two different polarizations, comprising two high impedance surfaces, the two high impedance surfaces each comprising an array of wire spirals arranged in a parallel relationship, the two high impedance surfaces being disposed proximate each other with the plurality of parallel wire spirals of one high impedance structure being arranged orthogonally relative to the plurality of parallel elongate wire spirals of the other high impedance structure, the two high impedance surfaces having different impedance characteristics.

The present invention, in another aspect thereof, provides an antenna aperture for steering a radio frequency beam using a high impedance surface, the high impedance surface comprising a plurality of wire spirals arranged in a generally parallel relationship to one another, neighboring wire spirals in said plurality having different impedance characteristics. A second high impedance surface may be provided comprising a second plurality of wire spirals arranged in a generally parallel relationship to one another, neighboring wire spirals in said second plurality having different impedance characteristics, the second plurality of wire spirals being disposed essentially orthogonally to the first mentioned plurality of wire spirals.

DETAILED DESCRIPTION

In accordance with the present invention a tunable wire is provided consisting of a wire spiral which may be smaller in outside diameter than one-half a wavelength at its resonance frequency. The tunable wire consists of a helical conductor in the form of a wire spiral or spring. The spring may serve as a tunable reflector or beam director useable in various antenna applications.

Figure 1:
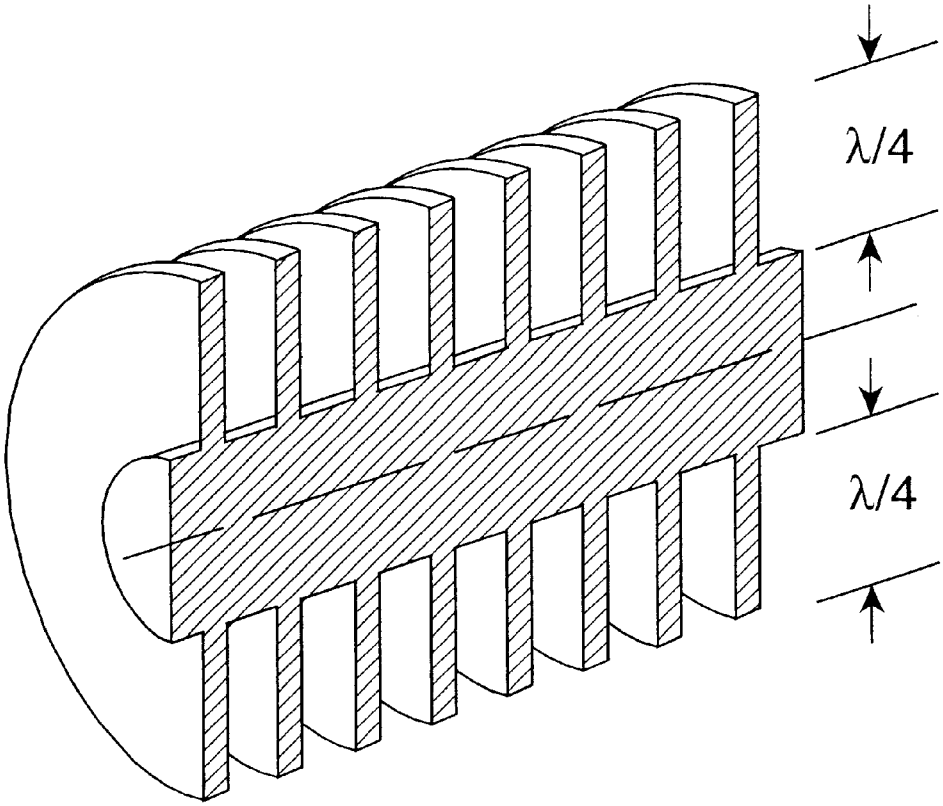
FIG. 1 PRIOR ART
FIG. 1 shows a perspective view cross-section depiction of an example of a prior art corrugated metal cylinder.
Figure 2B:
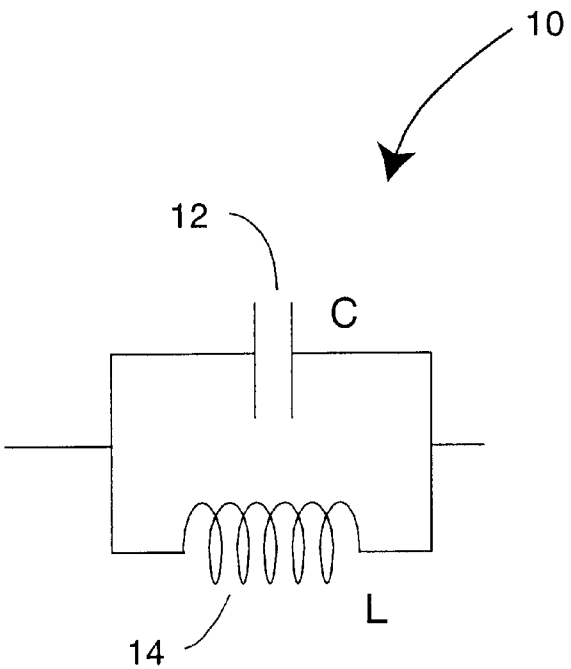
FIGS. 2*a* and 2*b* show the capacitances and inductances associated with a wire spiral.
Figure 2A:
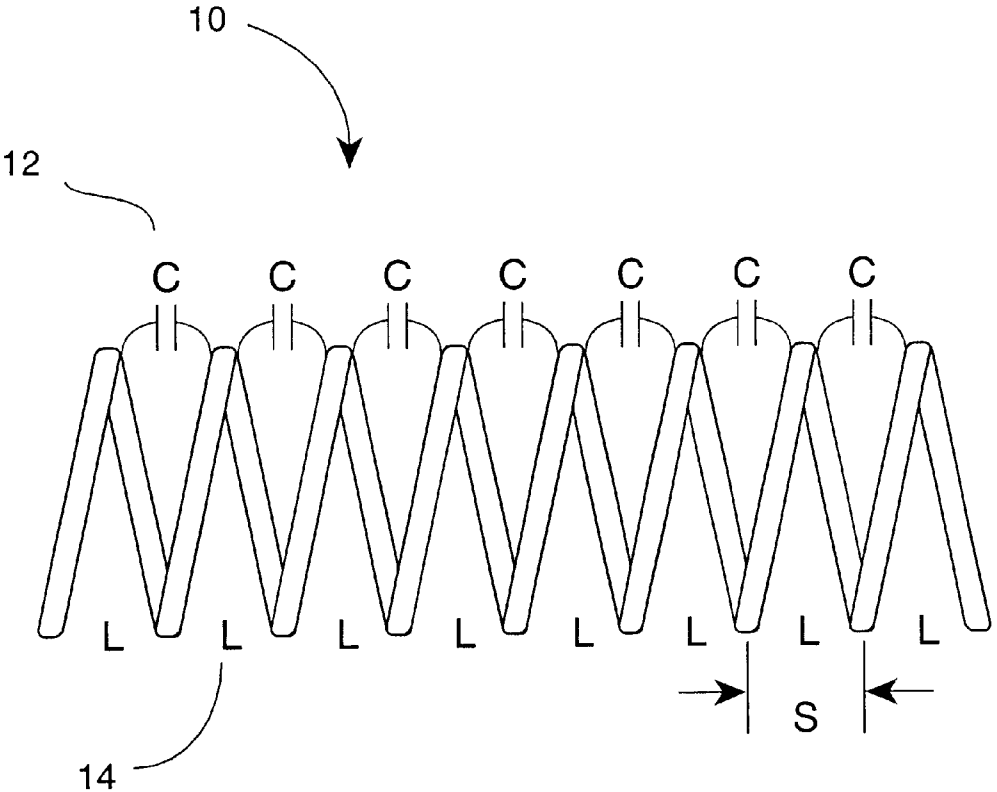

The basic concepts of the wire spiral or spring 10 are shown by FIGS. 2*a* and 2*b*. It is well known that any spiral inductor 10 has a resonance frequency, which is related to the capacitance 12 and inductance 14 between the individual turns of a helical wire. This resonance frequency is usually considered something to be avoided, and is thought to limit the maximum usable frequency of the inductor. In accordance with the present invention, the resonant properties of the inductor are used to provide new advantageous behavior. Near the resonance frequency, currents are prevented from propagating, and the structure behaves as though it has a high electromagnetic impedance. Furthermore, the impedance is a function of frequency and can be tuned by changing the resonance frequency of the wire spiral.

From another viewpoint, the present invention resembles the slow wave structures that are used in traveling wave tubes. If the concepts of the slow wave spiral is extended to the point where the electromagnetic waves actually stop, and form a standing wave, the device resembles what is commonly known as an "electromagnetic bandgap structure", but with periodicity only in one dimension. Through capacitive loading, the wire spiral can be made with an outside diameter which is much smaller than the operating wavelength. As a result of this feature, a plurality of wire spirals may be arranged parallel to one another with the center-to-center spacings of the spirals also being much smaller than the operating wavelength. Furthermore, such a structure is easily tunable by simply stretching or compressing the spiral.

Figures 3A, 3B:
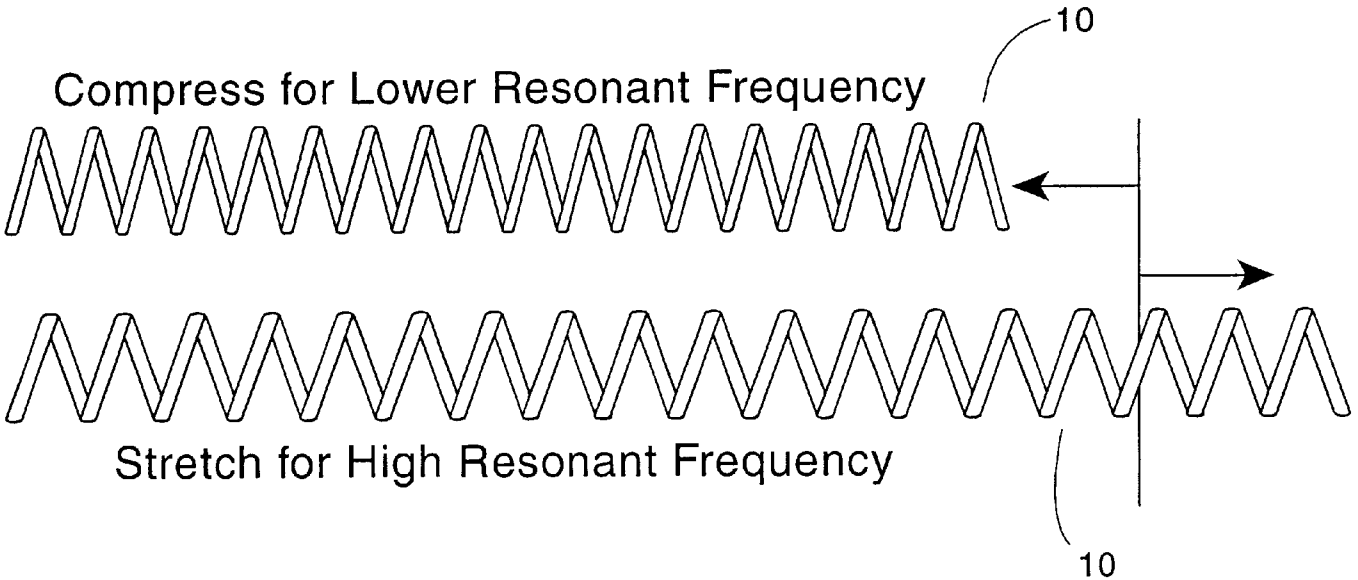
FIG. 3*a* depicts a wire spiral which is compressed to lower its resonant frequency.
FIG. 3*b* depicts a wire spiral which is stretched to raise its resonant frequency.

The resonant properties of the spiral wire or spring 10 can be changed through a variety of techniques. A mechanical technique is depicted by FIG. 3*a* in which the spiral wire or spring is compressed to lower its resonant frequency, or as shown in FIG. 3*b* in which the spiral wire 10 is stretched to raise its resonant frequency. The inductance of the spiral is roughly independent of its pitch, while the capacitance between the individual turns varies strongly with the amount of separation. The resonance frequency is $\omega=1/\sqrt{LC}$. Thus, a simple mechanical actuator can tune the spiral (or series of spirals) into or out of resonance at a given frequency.

The spiral wire or spring 10 can be tuned, if desired, by non-mechanical means. For example, the capacitance C can be tuned by the use of a variable dielectric material, inserted as a liquid or paste in and/or between the spirals of the wire spiral or spring 10. The variable dielectric material can be activated by electrical, magnetic or thermal means, by passing a DC or AC current through the wire spiral. An electrically actuated material can be a liquid crystal material or a ferroelectric material such as barium strontium tinanate. Such materials require a finite electric field which can be create by propagating a strong radio frequency signal down the wire spiral 10, in a manner similar to that done in traveling wave tubes. Magnetic actuation can be achieved by filling the spiral with a ferrite material which changes its magnetic permeability with the application of a DC current to the spiral wire 10. This causes a change of inductance, rather than capacitance, but the net result is the same, the impedance of the spiral wire 10 is varied. Finally, thermal actuation can be accomplished with a material having a large coefficient of thermal expansion, such as a dense, but expandable, dielectric foam. This last method would provide the slowest form of actuation, and therefore for most applications would be the least desirable. But any these techniques, or any other technique of changing the capacitance and or inductance of the spiral wire 10, may be used.

Figure 4A:
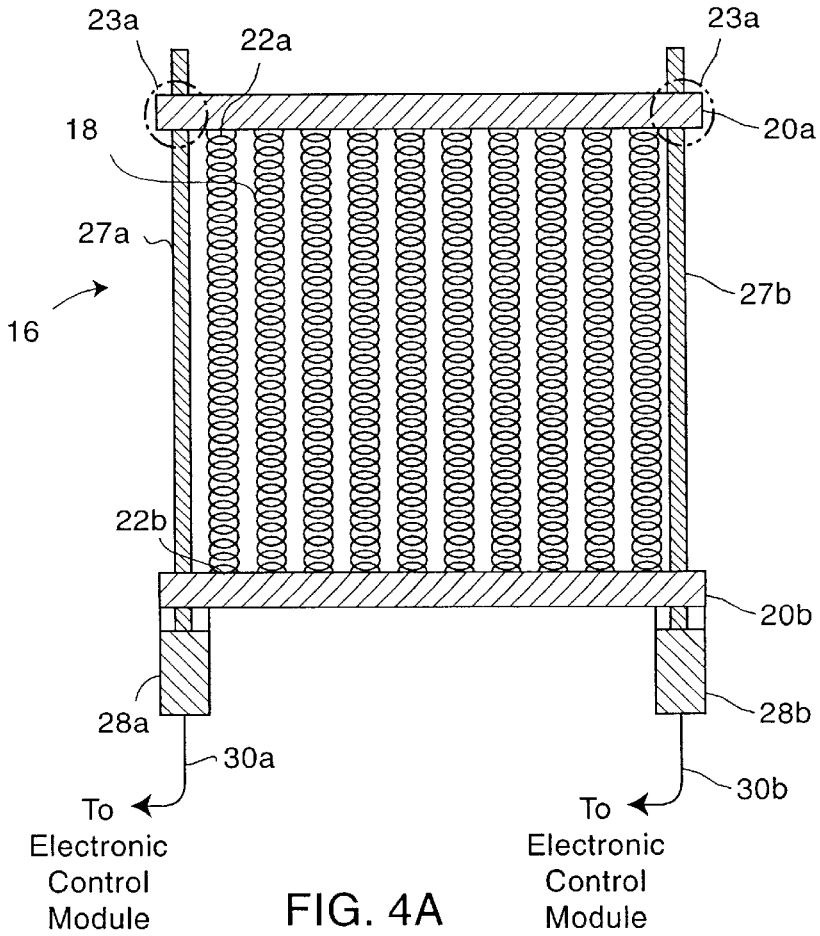
FIGS. 4*a* and 4*b* show an embodiment of a mechanical actuator which can be used to steer a beam having, for example, a 10 GHz center frequency, using a plurality of wire spirals.
Figure 4B:
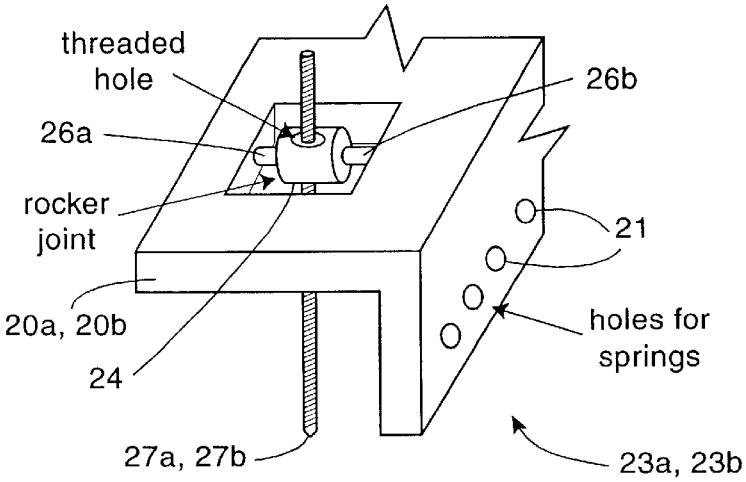

Referring to FIGS. 4*a* and 4*b*, there is shown an embodiment of a mechanical actuator which can be used to steer, for example, a beam having, for example, a 10 GHz center frequency. As is described below, the sizes of the structure and its components can be adjusted to steer beams of other frequencies. For this 10 GHz embodiment actuator 16 includes a plurality 18 of metal wire spirals or springs 10, each having an outer diameter of 1 mm, wound from wire having a 0.1 mm diameter, and having a plurality of individual spirals. The nominal pitch of each spring (i.e. the spacing between adjacent spirals) is 0.2 mm, and the springs are spaced 2 mm center-to-center. Of course, other dimensions may be used, depending on the frequency of interest. To steer a 10 GHz beam, at least several wavelengths square area should be provided. For this embodiment, the total area of the aperture is selected to be 6 in (15 cm) by 6 in (15 cm). Springs 18 are held by a pair of metal plates 20*a*, 20*b* at the top and bottom of the actuator. The metal plates preferably have a series of holes 21 therein (see FIG. 4*b*), into which the ends 22*a*, 22*b* of the springs may be conveniently attached so that the wire spirals or springs 18 are arranged parallel to one another and moreover define a generally planar surface from which radio frequency signals will reflect (see also FIG. 5). Other means for attaching the wire spirals or springs 18 to the metal plates 20*a*, 20*b* may be used and, if desired, plates 20*a*, 20*b* may be made of non-metallic materials. As can be best seen in FIG. 4*b*, a perspective detailed view of 23*a*, 23*b*, at each end of metal plates 20*a*, 20*b* there are rocker joints 23*a*, 23*b* consisting of a threaded movable cylinder 24, which is suspended from the plates by a pair of rotary joints 26*a*, 26*b*. Movable cylinder 24 can rotate freely within the metal plate. Into each of these cylinders 24, one of the pair of threaded screws 27*a*, 27*b* is threaded. These screws can be of any convenient dimension, for example, ⅛ inch diameter, 20 threads per inch. The screws 27*a*, 27*b* are free to rotate within the lower metal plate 20*b*, which has no rocker joint, and is not threaded. However, as a screw is turned, it applies a force to the threaded rocker joint on top metal plate 20*a*, which moves the metal plate up or down. This turning of the screws 27*a*, 27*b* may be accomplished, if desired, by a pair of motors 28*a*, 28*b*, one for each screw, mounted below lower metal plate 20*b*. Power cables 30*a*, 30*b* to these motors are routed to an electronic control module (not shown), which activates the motors.

In order to steer a reflected microwave beam, the screws 27*a*, 27*b* are turned in opposite directions, so that the ends of the top plate 20*a* move in opposite directions relative to the bottom plate 20*b*. As such, the frame defined by the plates 20*a*, 20*b* and the screws 27*a*, 27*b*, provides an adjustable trapezoidal shape so as to differentially tune the impedances of the springs 18 supported by the frame. The tuning action provided by the screws 27*a*, 27*b* applies a tension gradient to the array of wire spirals or springs 18, which changes the resonance frequency of each spring. The result is that a reflected beam is steered.

If desired, the resonant frequency of all the springs can be simultaneously changed by turning the screws 27*a* and 27*b* in the same direction.

As the mechanical actuator of FIG. 4*a* is tuned, the top and bottom plates 20*a,* 20*b* move from the parallel relationship shown in FIG. 4*a* to a non-parallel relationship. In this embodiment the wire spirals or springs 18 will then also become non-parallel as the top and bottom plates 20*a,* 20*b* assume a non-parallel relationship. However the amount by which the spirals 18 become non-parallel is may be quite small and may be insignificant, especially if the mechanical actuator is large and/or the amount of adjustment needed to tune the wire spirals or springs 18 is small. However, if non-parallel wire spirals 18 is of concern, then the mechanical actuator can be modified to keep the wire spirals or springs 18 parallel to each other as their lengths are adjusted. For example, if bottom frame 20*b* is replaced with a frame member like element 20*a* with a rotary joint similar to that shown in FIG. 4*b* and the screws 27*a* and 27*b* are replaced with a double-threaded screws where each end of the screw is threaded in an opposite direction, then rotation of such double threaded screws would cause the mechanical actuator to assume the shape of a symmetrical trapezoid. But then the wire spirals or springs 18 would remain parallel. The screws could still be motor driven, with the motors 28*a,* 28*b* attached to a separate rigid plate, if desired.

The resonance frequency of the wire spirals 18 is approximately a function of $\sqrt{s}$, where s is the spacing distance of the individual spirals in a wire spiral or spring 18 (see FIG. 2*a*). The impedance would follow a similar function. This can be approximated as a linear function for small spacings s.

To provide a parabolic function useful to focus an incident wave, for example, the mechanical actuator depicted in FIG. 4*a* should perhaps have a flexible frame as opposed to a rigid frame such as that depicted by FIG. 4*a*. For example, the top plate 20*a,* if made from a flexible plastic material, could be made to flex, especially if one of the rocker joints, such as joint 23*a,* were replaced with rigid joint (such as a threaded hole in top plate 20*a* for screw 27*a*). In that way, the top plate 20*a* will then flex when the other screw (screw 27*b*) is adjusted.

To provide a quarter wave plate, no phase gradient is needed. The mechanical actuator would just have to be tuned to provide 90 degree of phase sift with respect to the opposite polarization.

Figure 5:
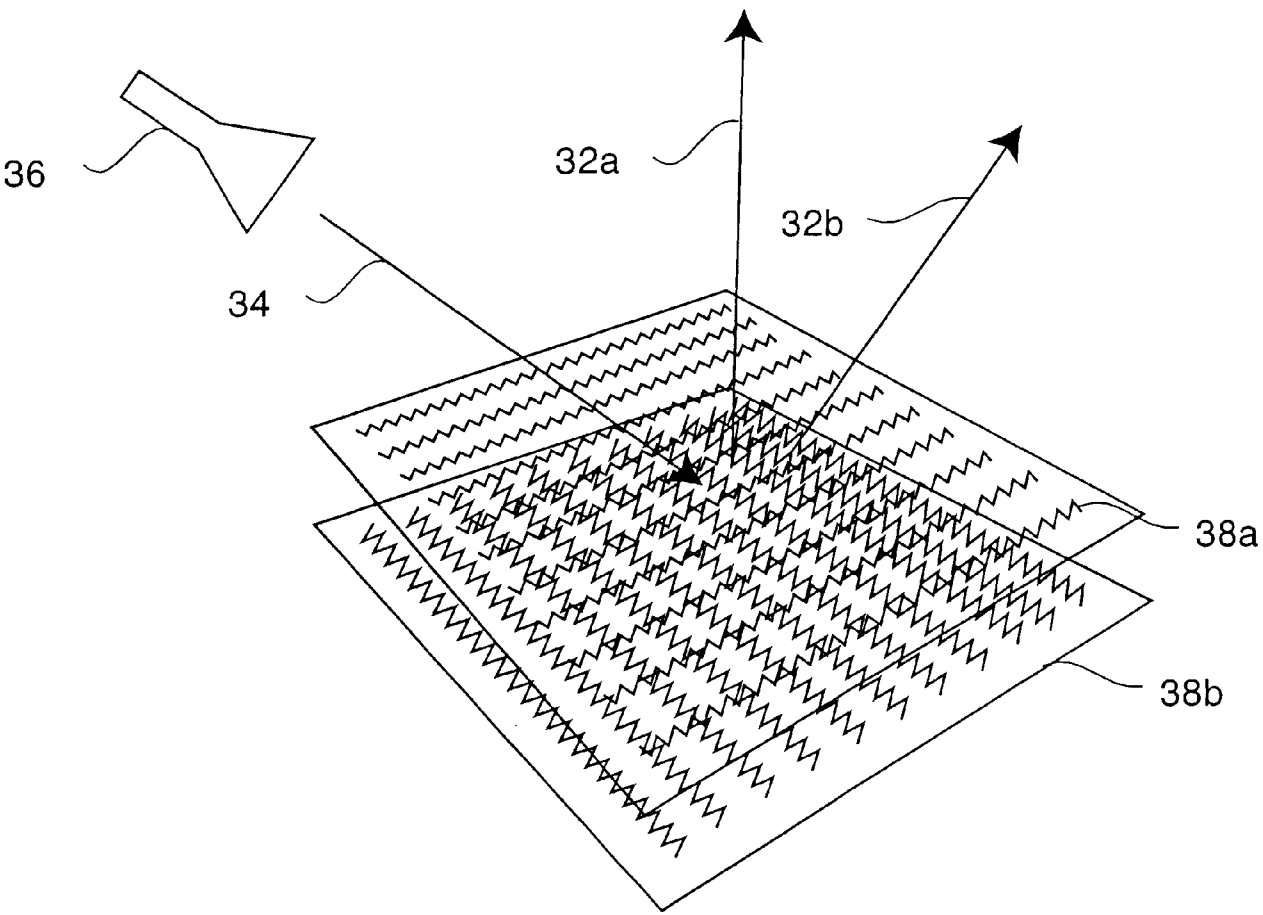
FIG. 5 shows an embodiment of a mechanical actuator which can be used to steer two polarizations of a radio frequency beam.

In accordance with another embodiment of the invention shown in FIG. 5, the steering or focusing of a radio frequency beam in more than one polarization can be achieved with more than one grid of tunable spiral wires or springs 18. Since the spiral wires only have an effect when the electric field is oriented parallel to the spiral's major axis, two polarizations 32*a,* 32*b* of a microwave beam 34 from a feed horn 36 can be steered independently by using two such grids 38*a,* 38*b* aligned with the spiral's major axes perpendicular to each other. Each grid 38*a,* 38*b* may be provided by the structure shown in FIGS. 4*a* and 4*b,* for example. By varying the reflection phase (which is determined by the impedance) as a function of position on the grid, a beam can be effectively steered. Those skilled in the art will appreciate that the spiral wires can be tuned with a single actuator by suspending them in an adjustable trapezoidal frame, such as that described with respect to FIGS. 4*a* and 4*b*.

Figure 6B:
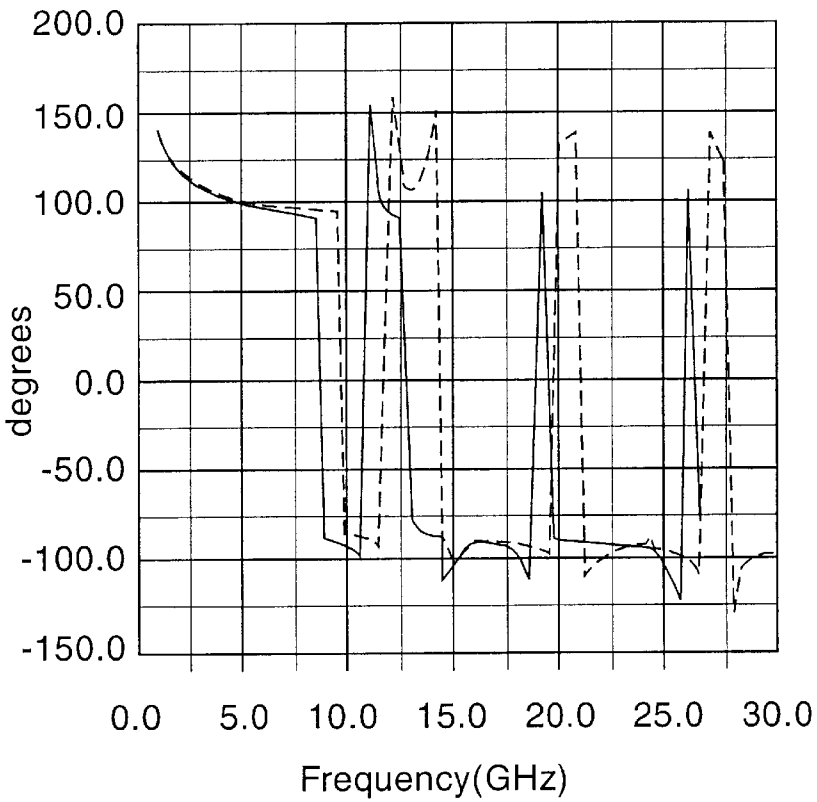
FIG. 6*a* and 6*b* show reflection test data based on a simulation of a wire spiral.
Figure 6A:
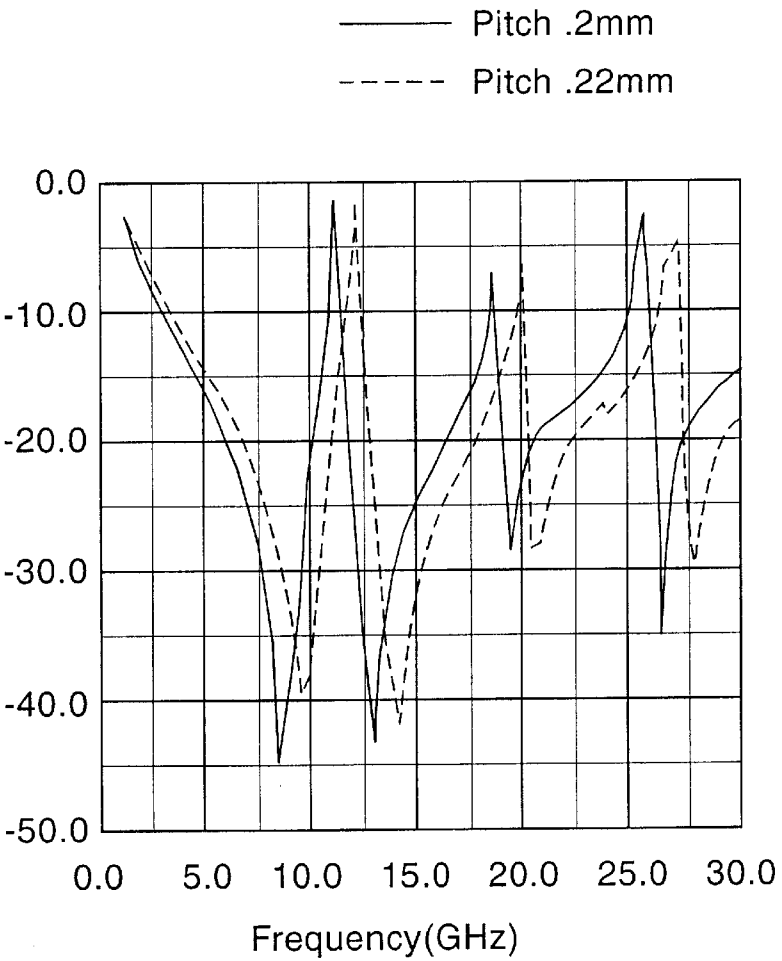
Figure 7B:
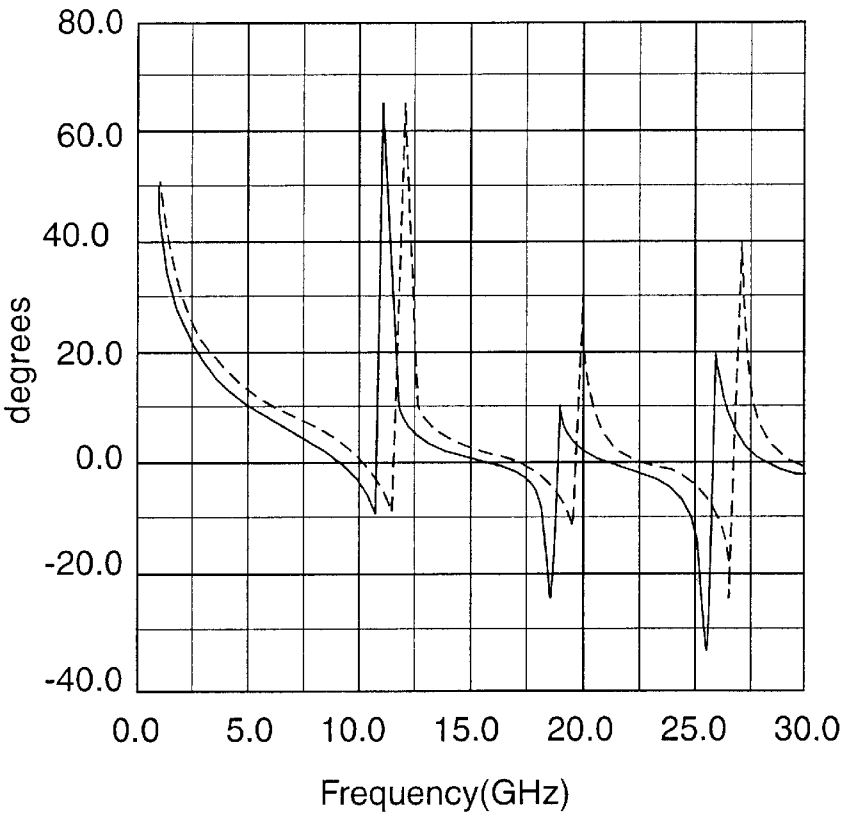
FIG. 7*a* and 7*a* show transmission test data based on a simulation of a wire spiral.
Figure 7A:
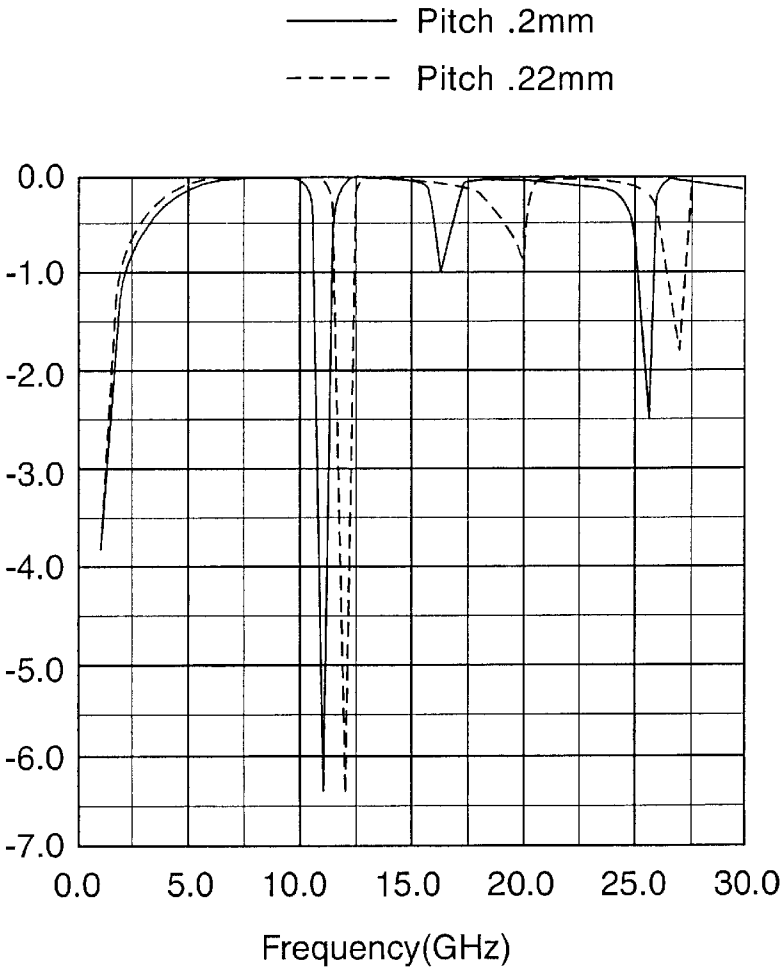

Simulations were undertaken for a wire spiral or spring 18 with a diameter of 1 mm, wound from a wire of 0.1 mm diameter, with a pitch of 0.2 mm (see the data represented in solid lines in FIGS. 6*a* and 6*b*) and, for the same spring stretched to a pitch of 0.22 mm (see the data represented in broken lines). The simulation simulated an array of parallel spiral wires or springs 18 spaced 2 mm centerline to centerline. Resulting reflection data are plotted in FIG. 6*a* (magnitude) and FIG. 6*b* (phase), while transmission data are plotted in FIG. 7*a* (magnitude) and FIG. 7*b* (phase). (Note: 180° discontinuities in the phase plots are an artifact of the simulation.)

As expected, the spiral shorts out the waveguide at very low frequencies and also at higher order resonances. As the frequency approaches the first resonance near 10 GHz, the reflection drops and the transmission increases, indicating that the spiral appears more transparent. Near the resonance frequency, the wire spiral or spring 18 also causes a frequency-dependent phase shift for both the reflected and transmitted waves. It is this phase shift which could be used for beam steering, by stretching or compressing the spring to cause a shift in the resonance frequency. A linear array of such springs can be made to steer a beam by simply stretching the springs at one end or compressing the wire spirals 18 at the other end (as described above with respect to FIGS. 4*a* and 4*b*), thus causing a shift in the transmission or reflection phase as a function of position on the array.

The simulations are for a single spring in a waveguide, but the results also apply to an infinite array of springs because of the effective image springs created in the waveguide walls. Thus, an infinite array of identical springs with spacing less than one-half wavelength would not be expected to scatter strongly into other directions.

The simulations show that the disclosed structure provides a suitable surface for reflecting radio frequency beams in a band around a centerline frequency, such as the 10 GHz frequency used with the 1 mm diameter spirals used in the simulations. Indeed it should be appreciated that the diameter of the spirals (1 mm) is only about 1/30th of one wavelength of the 10 GHz centerline frequency, so the outside diameter of the elongate springs 18 is much less than the outside diameter of prior art corrugated wires. This smaller size in turn permits an array of parallel elongate wire spirals 18 to be spaced much more closely than could prior art devices. In the simulation, the spacing between elongate wire spirals 18 was taken as 2 mm which is only about 1/15th of one wavelength of the 10 GHz centerline frequency, so the spacings of the elongate wire spirals 18 is much less than could be obtained with prior art devices given the relatively large outside diameter of their corrugations.

Thus, the tunable impedance spiral can be made much smaller than the wavelength at resonance using geometries that are easily manufactured. Wire spirals and tunable actuators can be easily made to work at other frequencies than the 10 GHz example previously discussed. Consider a spiral in which the outside diameter of the spiral is D, the diameter of the thin wire making up the spiral is d, and the separation between each coil is s. The inductance per unit length of such a structure is given approximately by:

$$L = \frac{\mu \pi D^2}{4s^2}$$

The capacitance between the coils, normalized to a unit length of spiral, is given approximately by:

$$C = \frac{\pi^2 \varepsilon D s}{\cosh^{-1}(s/d)}$$

The resonance frequency is given approximately by:

$$f = \frac{1}{2\pi\sqrt{LC}}$$

These formulas can be used to size the wire spirals to the frequency of interest.

Figure 8:
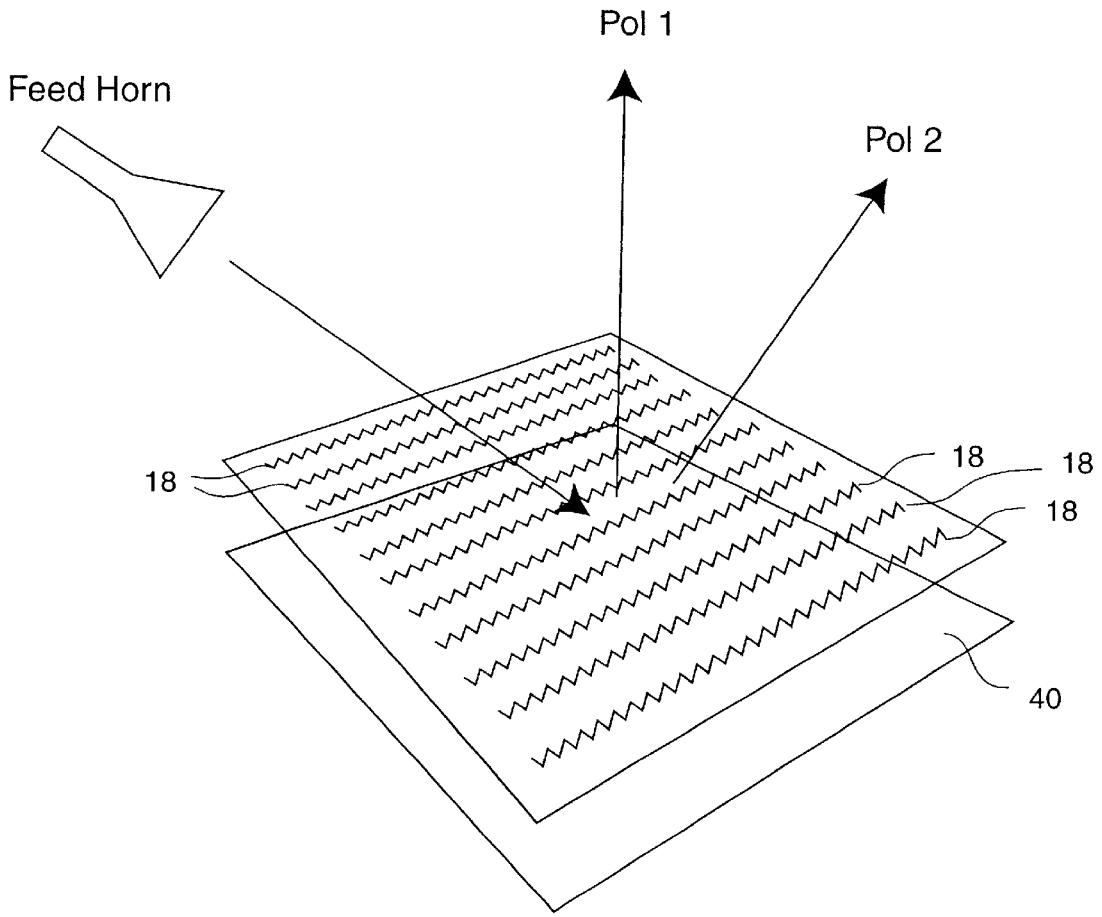
FIG. 8 depicts an embodiment of a mechanical actuator with a reflective surface.

For relatively low frequencies, the disclosed structure is reflective for waves polarized along the axis of the wire spirals or springs 18, since such low frequencies are far from the resonant frequency of the wire spirals or springs 18. The structure becomes transparent to frequencies near the resonance frequency of the wire spirals or springs 18, where the phase shift is also the greatest. As such, if a reflective sheet 40 is disposed immediately behind the array of spirals, as is shown in FIG. 8, such a structure would retain its reflectivity for radio frequency waves over a wide range of frequencies, including the resonance frequency of element 18. However, a phase shift would occur at the resonance frequency of the wire spirals or springs 18. Also, the phase shift behavior is very sensitive to a small mount of mechanical motion. The device shown by FIG. 8 is useful for steering an RF beam in reflection mode with a minimum amount of mechanical motion.

The wire spirals 18 could be subject to vibrations in certain applications of the present invention. If such vibrations are objectional, then the spiral wires 18 can be damped surrounding them with a viscous liquid. Also, in some embodiments, vibrations might well be useful and therefore be intentionally induced. For example, time-periodic vibrations can be induced into the structure to provide for for periodic scanning of the antenna.

Having described the invention in connection with certain embodiments thereof, modification will now certainly suggest itself to those skilled in the art. As such, the invention is not to be limited to the disclosed embodiments except as required by the appended claims.

What is claimed is:

1. A tuneable impedance structure comprising:

(a) a plurality of electrically conductive elongate wires, each conductive elongate wire being defined by a plurality of spirals, the spirals of each conductive elongate wire having a pitch and being spaced apart along a major axis of said conductive elongate wire; and (b) an arrangement for varying the pitch of the spirals of said plurality of conductive elongate wires to thereby tune the impedance of said tuneable impedance structure.

2. The tuneable impedance structure of claim 1 further including a frame for supporting said plurality of said elongate wires.

3. The tuneable impedance structure of claim 2 wherein said frame assumes a trapezoidal shape, the trapezoidal shape of the frame being adjustable to differentially tune the impedances of said plurality of said elongate wires.

4. The tuneable impedance structure of claim 3 wherein the structure is tuneable to a frequency band of interest, the band having a center frequency, the plurality of elongate wires, the spirals of each elongate wire having an outside diameter which is less than the wavelength of the center frequency.

5. The tuneable impedance structure of claim 4 wherein the plurality of elongate wires, the spirals of each elongate wire having an outside diameter which is less than 10% of the wavelength of the center frequency.

6. The tuneable impedance structure of claim 5 wherein the plurality of elongate wires, the spirals of each elongate wire having an outside diameter which is about 1/30th of the wavelength of the center frequency.

7. The tuneable impedance structure of claim 4 wherein the major axes of the plurality of elongate wires are disposed essentially parallel to each other, with a spacing between centerlines of the major axes of each elongate wire being a distance which is less than one-half the wavelength of the center frequency.

8. The tuneable impedance structure of claim 7 wherein the spacing between centerlines of the major axes of each elongate wire is a distance which is less than 10% of the wavelength of the center frequency.

9. The tuneable impedance structure of claim 5 wherein the spacing between centerlines of the major axes of each elongate wire is a distance which is about 1/15th of the wavelength of the center frequency.

10. A tunable antenna aperture for steering a radio frequency beam having two different polarizations, comprising two tuneable impedance structures as claimed in claim 4, the two tuneable impedance structures being disposed proximate each other with the plurality of essentially parallel elongate wire spirals of one tuneable impedance structure being arranged orthogonally relative to the plurality of essentially parallel elongate wire spirals of the other tuneable impedance structure.

11. The tuneable impedance structure of claim 2 further including a radio frequency reflecting surface disposed adjacent said frame.

12. The tuneable impedance structure of claim 1 further including a radio frequency reflecting surface disposed adjacent said at least one elongate wire.

13. A method of tuning a high impedance surface comprising:

arranging a plurality of elongated wire spirals in a generally planar and parallel relationship, each spiral having a pitch associated therewith; and varying the pitch of each of the wire spirals to thereby tune the impedance of said high impedance surface.

14. The method of claim 13 wherein said plurality of elongated wire spirals are arranged in a frame having an adjustable and generally trapezoidal shape, and wherein the step varying the pitch of each of the wire spirals including adjusting the shape of the frame.

15. The method of claim 14 wherein the high impedance surface is tuneable to a frequency band of interest, the frequency band having a center frequency, the method including sizing an outside diameter of the plurality of wire spirals to be less than the wavelength of the center frequency.

16. The method of claim 15 wherein the plurality of elongate structures each are sized to have an outside diameter which is less than 10% of the wavelength of the center frequency.

17. The method of claim 16 wherein the plurality of elongate structures each are sized to have an outside diameter which is about 1/30th of the wavelength of the center frequency.

18. The method of claim 15 further including disposing the plurality of elongate wire spirals with a spacing between centerlines of the major axes of each elongate wire spiral being a distance which is less than one-half the wavelength of the center frequency.

19. The method of claim 18 wherein the plurality of elongate wire spirals are disposed with the spacing between centerlines of the major axes of each elongate wire spiral being less than 10% of the wavelength of the center frequency.

20. The method of claim 19 wherein the plurality of elongate wire spirals are disposed with the spacing between centerlines of the major axes of each elongate wire spiral being about 1/15th of the wavelength of the center frequency.

21. The method of claim 13 further including a step of disposing a radio frequency reflective surface adjacent said a plurality of elongated wire spirals.

22. An antenna aperture for steering a radio frequency beam having two different polarizations, comprising two high impedance surfaces, the two high impedance surfaces each comprising an array of wire spirals arranged in a parallel relationship, the two high impedance surfaces being disposed proximate each other with the plurality parallel wire spirals of one high impedance structure being arranged orthogonally relative to the plurality of parallel elongate wire spirals of the other high impedance structure, the two high impedance surfaces having different impedance characteristics.

23. The antenna aperture of claim 22 wherein neighboring wire spirals in each high impedance surface have different impedance characteristics.

24. The antenna aperture of claim 22 further including means for differentially changing the impedance of neighboring wire spirals in each high impedance surface to have different impedance characteristics.

25. The antenna aperture of claim 24 wherein said means for differentially changing the impedance of neighboring wire spirals in each high impedance surface comprises an adjustable frame.

26. An antenna aperture for steering a radio frequency beam using a high impedance surface, the high impedance surface comprising a plurality of wire spirals arranged in a generally parallel relationship to one another, neighboring wire spirals in said plurality having different impedance characteristics.

27. The antenna aperture of claim 26 further including a second high impedance surface disposed proximate and parallel to the first mentioned high impedance surface.

28. The antenna aperture of claim 27 wherein the second high impedance surface comprise a second plurality of wire spirals arranged in a generally parallel relationship to one another, neighboring wire spirals in said second plurality having different impedance characteristics, the second plurality of wire spirals being disposed essentially orthogonally to the first mentioned plurality of wire spirals.

29. A tunable antenna aperture for steering a radio frequency beam having two different polarizations, the antenna aperture including two tuneable impedance structures, each tunable impedance structure comprising:

(a) a plurality of electrically conductive spiral elements, each element including a plurality of spirals, the spirals of each element having a pitch and being spaced apart along a major axis of each said element, the spiral elements of each tunable structure being disposed essentially parallel to each other; and (b) an arrangement for varying the pitch of the spirals of said plurality of elements of each tunable impedance structure to thereby tune the impedance of said tunable antenna aperture;

and wherein the two tuneable impedance structures are disposed proximate each other with the plurality of spiral elements one tuneable impedance structure being arranged orthogonally relative to the plurality of spiral elements of the other tuneable impedance structure.

30. A tunable antenna aperture of claim 29 wherein each tunable impedance structure further includes a frame for supporting said plurality of spiral elements.

31. A tunable antenna aperture of claim 30 wherein said frame assumes a trapezoidal shape, the trapezoidal shape of the frame being adjustable to differentially tune the impedances of said plurality of said spiral elements.

32. A tunable antenna aperture of claim 31 wherein the tunable impedance structures are tuneable to a frequency band of interest, the band having a center frequency, the plurality of spirals of each spiral element having an outside diameter which is less than the wavelength of the center frequency.

33. A tunable antenna aperture of claim 32 wherein the spirals of each spiral element of each tunable impedance structure have an outside diameter which is less than 10% of the wavelength of the center frequency.

34. A tunable antenna aperture of claim 33 wherein the spirals of each spiral element of each tunable impedance structure have an outside diameter which is about 1/30th of the wavelength of the center frequency.

35. A tunable antenna aperture of claim 34 wherein the major axes of the plurality of spiral element of each tunable impedance structure are disposed essentially parallel to each other, with a spacing between centerlines of the major axes of each spiral element of each tunable impedance structure being a distance which is less than one-half the wavelength of the center frequency.

36. A tunable antenna aperture of claim 35 wherein the spacing between centerlines of the major axes of each spiral element of each tunable impedance structure is a distance which is less than 10% of the wavelength of the center frequency.

37. A tunable antenna aperture of claim 36 wherein the spacing between centerlines of the major axes of each spiral element of each tunable impedance structure is a distance which is about 1/15th of the wavelength of the center frequency.

* * * * *